United States Patent [19]

Blaimschein

[11] Patent Number: 5,033,726

[45] Date of Patent: Jul. 23, 1991

[54] APPARATUS FOR SPREADING SHEET MATERIAL

[76] Inventor: Gottfried Blaimschein, Arnhalmweg 33, A-4407 Steyr, Austria

[21] Appl. No.: 490,085

[22] Filed: Mar. 7, 1990

[30] Foreign Application Priority Data

Mar. 14, 1989 [AT] Austria ..... 580/89

[51] Int. Cl.[5] ..... B65H 29/46

[52] U.S. Cl. ..... 270/31

[58] Field of Search ..... 270/30, 31; 242/58, 242/58.6

[56] References Cited

U.S. PATENT DOCUMENTS

| | | | |
|---|---|---|---|
| 2,118,556 | 5/1938 | Haberstump | 270/31 |
| 3,260,143 | 7/1966 | Von Rudgisch | 270/31 |
| 3,332,681 | 7/1967 | Gilbert | 270/31 |
| 3,567,211 | 3/1971 | Martin | 270/31 |
| 4,595,328 | 6/1986 | Seitz | 270/31 |

*Primary Examiner*—Edward K. Look
*Assistant Examiner*—Therese M. Newholm
*Attorney, Agent, or Firm*—Kurt Kelman

[57] ABSTRACT

An apparatus for rationally spreading a continuous length of different types of sheet material on a surface of a work table comprises a sheet material spreading carriage movable over the work table surface between a sheet material delivery station and a sheet material cutting station spaced therefrom, a cutting device arranged on the carriage behind the delivery position in the direction of supply of the sheet material for cutting the continuous length of sheet material spread on the working table surface into predetermined lengths, and a pressure roller mounted on the carriage and movable towards and away from the spread sheet material between an operative and rest position. The carriage comprises a supply of the sheet material, the sheet material supply including a rotatable storage drum, at least two drivable sheet material supply rolls rotatably journaled in the storage drum for supplying the sheet material and a sheet material clamp fixedly associated with each supply roll, the storage drum being rotatable into a sheet material delivery position wherein a respective one of the supply rolls and associated clamps are positioned adjacent the work table surface, the clamps being arranged to orient the sheet material supplied from the associated rolls at the delivery station to enclose an acute angle with the work table surface.

10 Claims, 1 Drawing Sheet

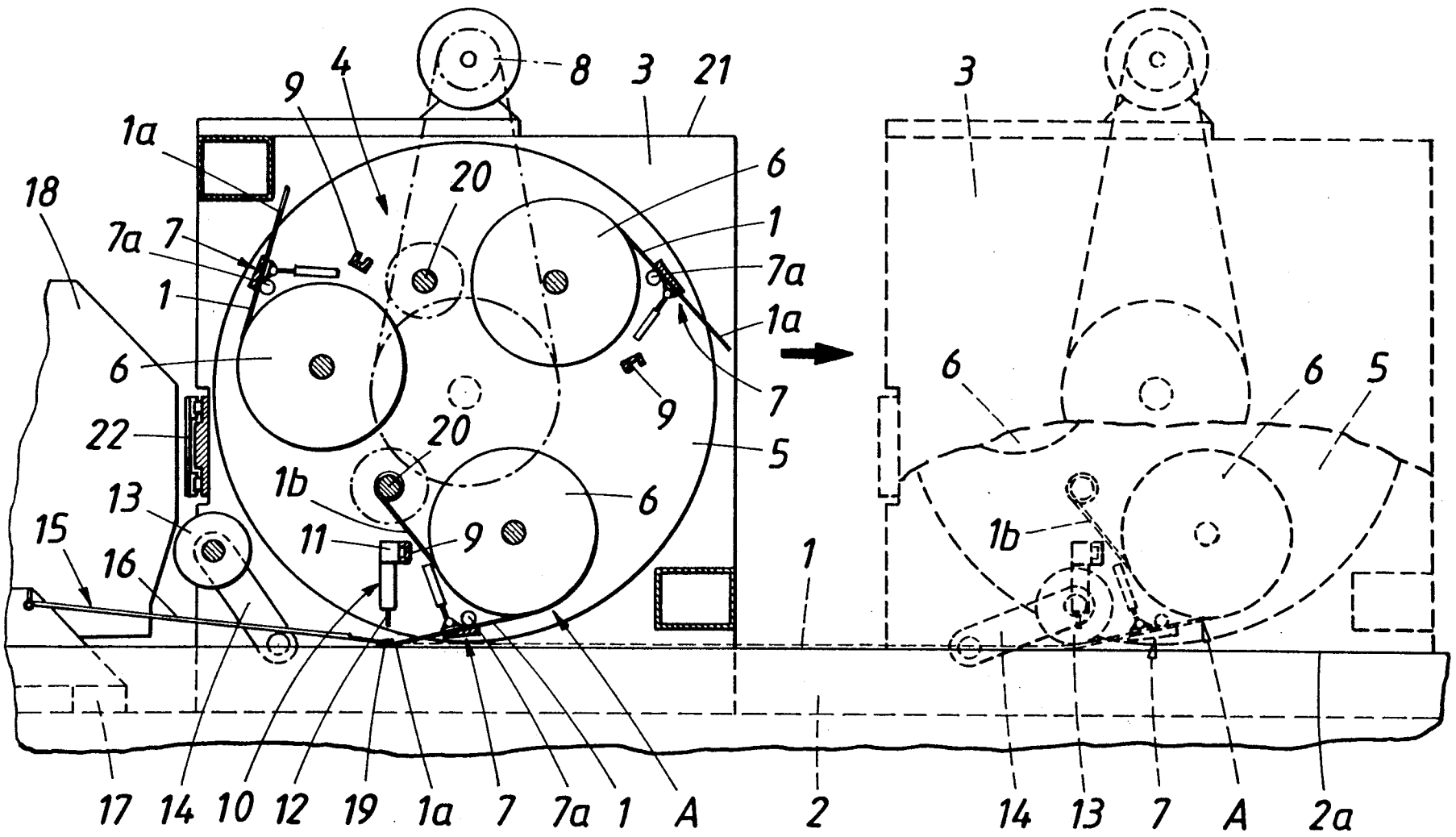
5
6
2a
A
7
13
14
1b
3
6
1
2
6
1
7a
1a
7
5
21
3
8
9
6
A
1
7a
7
1a
19
12
10
14
17
20
20
9
1b
11
4
9
1a
7
7a
1
6
22
13
16
15
18

APPARATUS FOR SPREADING SHEET MATERIAL

SUMMARY OF THE INVENTION (1) Field of the Invention

The present invention relates to an apparatus for spreading a continuous length of sheet material on a surface of a work table, which comprises a sheet material spreading carriage movable over the work table surface between a sheet material delivery station and a sheet material cutting station spaced therefrom, the carriage comprising a supply of the sheet material including rotatable supply rolls for supplying the sheet material, a clamping device for retaining the sheet material supplied from one of the rolls, a cutting device for cutting the continuous length of sheet material spread on the work table surface into predetermined lengths and, optionally, a retaining device for holding an end of the continuous length of sheet material supplied from a respective roll at the delivery station against the work table surface.

(2) Description of the Prior Art

To enable a continuous length of sheet material, such as fabrics, films and the like, to be handled automatically, such as to cut it into predetermined lengths, it must be spread on a surface of a work table. U.S. Pat. No. 4,514,246 discloses a spreading apparatus comprising a work table, a sheet material supply including one or two supply rolls at one end of the work table and a sheet material spreading carriage movable over the work table surface. The carriage is equipped with a clamping device which grips the end of the continuous length of sheet material paid out by the supply roll so that movement of the carriage reels the sheet material off the supply roll and spreads it over the work table surface, a cutting device at the end of the work table serving to cut the spread sheet material into desired lengths. By moving the spreading carriage several times back and forth over the work table surface, several plies of sheet material may be spread thereover and, if desired, the sheet material coming from both supply rolls may be spread together over the work table surface. However, since the sheet material must be pulled over the work table to be spread thereover and, therefore, must glide over the work table surface or a substrate, difficulties are frequently encountered in the operation of this apparatus. More particularly, spreading several plies of sheet material is difficult and usually requires the use of synthetic resin protective film.

Other apparatus for spreading a continuous length of sheet material are also known, in which the spreading carriage receives the sheet material supply and the other devices required for spreading the sheet material, such as clamps, cutters, retaining devices and the like, so that movement of the spreading carriages results in the unreeling of the sheet material so that the sheet material is spread without any pulling or gliding. However, the known sheet material supply on the spreading carriage comprises only one supply roll. This requires a frequent and inconvenient replacement of supply rolls for spreading different sheet materials or for spreading several plies of sheet material, involving interruptions in the operation and thus considerable time delays.

German patent application No. 2,312,635, published Sept. 19, 1974, shows a sheet material supply including a storage drum and two sheet material supply rolls rotatable journaled in the storage drum for supplying the sheet material but it does not relate to a sheet material spreading apparatus of the indicated type.

In the apparatus for cutting lengths of sheet material and for stacking the cut sheet material lengths, described in German patent No. 2,542,713, the spreading carriage must be moved back over the paid-out, loose length of sheet material, which may lead to misfunctions. Furthermore, it is not possible automatically to spread different types of sheet material or to superimpose plies of different materials.

SUMMARY OF THE INVENTION

It is the primary object of this invention to overcome the above-noted disadvantage and to provide an apparatus of the first-described type, which is relatively simple in construction and assures in a rational manner a fast and dependable spreading of continuous lengths of different sheet materials.

The above and other objects are accomplished according to the invention with such an apparatus wherein the sheet material supply includes a rotatable storage drum, at least two drivable sheet material supply rolls rotatably journaled ion the storage drum for supplying the sheet material and a sheet material clamp fixedly associated with each supply roll, the storage drum being rotatable into a sheet material delivery position wherein a respective one of the supply rolls and associated clamps are positioned adjacent the work table surface, the clamps being arranged to orient the sheet material supplied from the associated rolls at the delivery station to enclose an acute angle with the work table surface. A cutting device is arranged on the carriage behind the delivery position in one direction of supply of the sheet material for cutting the continuous length of sheet material spread on the working table surface into predetermined lengths, and a pressure roller is mounted on the carriage and movable towards and away from the spread sheet material between an operative and rest position.

The combination of the spreading carriage and sheet material supply enables large quantities of the same sheet material or different sheet materials to be spread and/or layered without interruption caused by a replacement of the supply rolls, depending on the type of sheet material on the supply rolls. Each supply roll in the storage drum may be brought into the delivery position simply by a controlled rotation of the storage drum, and the sheet material is then unreeled from the supply roll and spread over the work table surface as the carriage is moved thereover from the delivery station. Since the sheet material is deposited on the work table surface without gliding, sheet materials of various surface characteristics and corresponding friction or adhesion properties may thus be spread without problem in one or more plies, and the pressure roller guarantees the smooth spreading of the sheet material over the work table surface without any folds, as well as the proper unreeling of the sheet material from the supply roll and the deposition of the sheet material on the work table surface without slippage. Since a sheet material clamp is fixedly associated with each supply roll to retain or grip the end of the continuous length of sheet material coming from the supply roll until the movement of the carriage causes the spreading of the sheet material, positioning of each supply roll in the delivery position automatically positions the clamp and the sheet material end gripped thereby in the delivery position so that opening of the clamp frees the sheet material from restraint and enables the unrestrained sheet material to be guided to and over the work table surface. To assure a trouble-free start of the sheet material pay-out from the supply roll, a retaining device may be provided for holding an end of the continuous length of the sheet material at the delivery station against the work table surface after the clamp has been opened and until the pressure roller has been moved from its rest position into the operative position in which it presses against the sheet material. If the retaining device is movable relative to the spreading carriage and the cutting device is arranged on the carriage, the start and end of each spreading operation may be freely selected to enable the position and the length of the spread sheet material to be rationally predetermined. The fixed spacing between the cutting device and the clamp in the delivery position results in a piece of sheet material of constant length projecting beyond the gripped end of the sheet material after the spread sheet material has been cut so that a free sheet material end projects beyond the clamp at the beginning of each spreading cycle, which facilitates the operation. The rotatable storage drum provides a compact and simple construction which, at the same time, facilitates the replacement of supply rolls since its rotation enables each roll to be brought into the most convenient replacement position.

BRIEF DESCRIPTION OF THE DRAWING

The above and other objects, advantages and features of the present invention will become more apparent from the following detailed description of a now preferred embodiment thereof, taken in conjunction with the accompanying drawing showing a fragmentary, schematic longitudinal section of the apparatus.

DETAILED DESCRIPTION OF PREFERRED EMBODIMENT

The illustrated apparatus for spreading a continuous length of sheet material 1 on surface 2*a* of work table 2 comprises sheet material spreading carriage 3 movable over the work table surface between a sheet material delivery station (shown in full lines) and a sheet material cutting station (shown in phantom lines) spaced therefrom. The carriage comprises supply 4 of sheet material 1 and the sheet material supply includes rotatably drivable storage drum 5 housing three drivable sheet material supply rolls 6 rotatably journaled in the storage drum for supplying sheet material 1. The sheet material is reeled on the supply rolls and a sheet material clamp 7 is fixedly associated with each supply roll 6 for gripping end 1*a* of the continuous length of sheet material unreeled from the associated supply roll. Storage drum 5 is rotatable by drive 8 into sheet material delivery position A wherein a respective supply roll 6 and associated clamp 7 are positioned adjacent work table surface 2*a*. Clamps 7 are arranged to orient sheet material 1 supplied from associated rolls 6 at the delivery station to enclose an acute angle with work table surface 2*a*.

In addition to supply 4 of sheet material 1, spreading carriage 3 mounts cutting device 10 arranged on the carriage behind delivery position A in the direction of supply of the sheet material for cutting the continuous length of sheet material spread on the work table surface into predetermined lengths. A respective transverse guide track 9 is mounted on storage drum 5 and trails a respective clamp 7 for guidingly supporting a carriage 11 of the cutting device in the delivery position, cutting tool 12 being mounted on carriage 11. In this manner, the cutting device is displaceable transversely to the longitudinal extension of the length of sheet material paid out from roll 6 so that it may be transversely moved into a lateral rest position, in which it does not take up valuable space needed for spreading the sheet material or rotating the storage drum, and then along guide track 9 into an operative position when the spread sheet material is to be cut into a desired length. The guide tracks and the clamps are in fixed association with the supply rolls so that identical cutting conditions prevail for each supply roll.

Pressure roller 13 is also mounted on spreading carriage 3 and is movable towards and away from spread sheet material 1 between an operative position (shown in phantom lines) and a rest position (shown in full lines). Pivotal arm 14 pivotally mounts the pressure roller on carriage 3 for moving the pressure roller between the operative and rest positions, the pressure roller engaging sheet material 1 just behind clamp 7 in delivery position A and pressing the sheet material against work table surface 2*a* under an adjustable pressure force. In this manner, the engagement of the sheet material by pressure roller 13 may be adjusted to the gage of the sheet material and to the number of plies of sheet material being spread, and the pivotal arm enables not only the pressure arm but also makes it possible to pivot the pressure roller from the operative position into a rest position in which it is removed from delivery position A.

To enable the start of each spreading operation of sheet material 1 coming from respective supply roll 6 to proceed smoothly, pressure roller 13 is supplemented by retaining device 15 for holding end 1*a* of the continuous length of sheet material 1 at the delivery station against work table surface 2*a*. The illustrated retaining device comprises auxiliary carriage 17 movable over the work table surface when pressure roller 13 has been pivoted into its rest position, and retaining ledge 19 pivotally linked to the auxiliary carriage. The retaining ledge is a sheet metal element affixed to carrier arm 16 pivoted to auxiliary carriage 17 and is displaceable into delivery position A between cutting device 10 and the delivery position by relative movement of carriages 3 and 17. The illustrated auxiliary carriage is a tool carriage for cutting head 18 but it may be any type of carriage displaceably mounted on the work table for relative movement with respect to spreading carriage 3. Thus, an existing carriage supporting any additional operating tools may serve to support the retaining device but it is also possible to provide a special auxiliary carriage which is longitudinally adjustably coupled to spreading carriage 3 so that the two carriages operate as a unit while the longitudinally adjustable coupling enables the required relative movement between the carriages when the retaining device is used at the start of the operation.

If sheet material 1 is covered by cover film or layer 1*b*, the same may be unreeled at the same time that the sheet material is spread by providing driven, rotatable reeling drum 20 associated in storage drum 5 with at least one of the supply rolls for reeling the cover film of the sheet material supplied from associated supply roll 6. Before the start of a spreading operation, the end of cover film 1*b* is manually pulled off and attached to reeling drum 20 and when the reeling drum is rotated while the sheet material is paid out from supply roll 6, the cover film will be wound on reeling drum 20 and sheet material 1 will be spread on work table surface 2a without the cover film, the rotational speed of the reeling drum being synchronized with that of the associated supply roll. In this manner, the apparatus may also be used for spreading a sheet material with an adhesive surface to which a protective film is bonded, and when the protective film is pulled of by reeling drum 20, plies of the adhesive sheet material will adhere to each other when superposed.

When a supply roll must be replaced, this can be done easily by turning storage drum 5 until, for example, the supply roll to be exchanged is positioned in alignment with a charging opening 21 at the top of carriage 3 whence it may be removed by a crane or the like and through which a new supply roll may be loaded. End 1a of the sheet material on the new supply roll is then pulled into engagement with associated clamp 7 and the apparatus is in condition for starting the automatic spreading operation upon moving spreading carriage 3 to the selected starting position along the work table. At this point, pressure roller 13 is in its rest position and storage drum 5 has been rotated to place desired supply roll 6 into delivery position A. Auxiliary carriage 17 is then displaced relative to carriage 3 until retaining ledge 19 of retaining device 15 engages sheet material end 1a and presses the same against work table surface 2a. Associated clamp 7 at delivery position A is now opened and spreading carriage 3 is advanced along the work table in the direction of the heavy arrow shown in the drawing, which causes the sheet material, whose end 1a is gripped by retaining ledge 19, automatically to be unreeled from supply roll 6 and to be spread over work table surface 2a. When the spreading carriage has been displaced a sufficient distance to operate pressure roller 13, the pressure roller is pivoted into its operative position and takes over the gripping function from the retaining ledge during spreading of sheet material 1. However, it is also possible to arrange pressure roller 13 so that it is pressed against retaining ledge 19 upon displacement from the delivery station so that the retaining pressure of retaining device 15 is increased or is produced by the pressure of the pressure roller and, furthermore, freely rotating pressure roller 13 is rotated at the start of the carriage movement by the relative movement between carriages 3 and 17, and the pressure roller rolls from the retaining ledge onto the sheet material without danger of slippage. This avoids any disturbance in the spreading operation due to the engagement of the pressure roller with the spread sheet material. The displacement of spreading carriage 3 automatically unreels the continuous length of sheet material 1 from supply roll 6 at delivery position A and, while pressed against work table surface 2a by pressure roller 13, the sheet material is spread over the work table surface, guide rollers 7a adjacent clamps 7 assuring a uniform pay-out of the sheet material, independently of the diameter of the roll.

If sheet material 1 on the supply roll in operation carries a protective film 1b, an end of the protective film is manually lifted off the sheet material before the spreading operation is started and is affixed to associated reeling drum 20 which is driven at a rotating speed required to wind the protective film on the drum while the sheet material is unwound from supply roll 6.

When the desired length of sheet material 1 is spread on work table surface 2a, further movement of spreading carriage 3 is stopped, clamp 7 at delivery position A is engaged to grip the sheet material, pressure roller 13 is provided back into its rest position and cutting tool 12 of cutting device 10 is transversely moved into its operative position to sever the spread sheet material from the continuous length of sheet material on the supply roll while an end 1a thereof remains projecting beyond clamp 7, ready for the subsequent spreading operation. Spreading carriage 3 may now be moved into a parking position to enable the spread length of sheet material to be worked in any desired manner or it may be moved back into the starting position for spreading another ply of sheet material 1 over the spread length of sheet material in a subsequent spreading operation. If a ply of the same sheet material is to be laminated to this spread length of sheet material, the same supply roll remains at delivery position A in the subsequent spreading operation. If a ply of another sheet material is to be laminated to the spread sheet material, a respective supply roll 6 carrying this other sheet material is placed at the delivery position by rotating storage drum 5.

Since spreading carriage 3 and auxiliary carriage 17 are freely displaceable along work table 2, the beginning and the end of the spreading operation may be so selected that the length as well as the type of sheet material and the number of plies of the spread sheet material may be readily determined. It is also possible to equip spreading carriage 3 with a tool carrier schematically indicated at 22 for mounting additional operating tools so that the apparatus may be used not only for spreading sheet material but also, for example, for marking the sheet material or applying labels thereto.

What is claimed is:

1. An apparatus for spreading a continuous length of sheet material on a surface of a work table, which comprises a sheet material spreading carriage movable over the work table surface between a sheet material delivery station and a sheet material cutting station spaced therefrom, the carriage comprising (a) a supply of the sheet material, the sheet material supply including
  (1) a rotatable storage drum,
  (2) at least two drivable sheet material supply rolls rotatably journaled in the storage drum for supplying the sheet material and
  (3) a sheet material clamp fixedly associated with each supply roll,
  (4) the storage drum being rotatable into a sheet material delivery position wherein a respective one of the supply rolls and associated clamps are positioned adjacent the work table surface, the clamps being arranged to orient the sheet material supplied from the associated rolls at the delivery station to enclose an acute signal with the work table surface, (*b*) a cutting device arranged on the carriage behind the delivery position in the direction of supply of the sheet material for cutting the continuous length of sheet material spread on the working table surface into predetermined lengths, and (*c*) a pressure roller mounted on the carriage and movable towards and away from the spread sheet material between an operative and rest position.

2. The sheet material spreading apparatus of claim 1, wherein the sheet material supply includes three sheet material supply rolls.

3. The sheet material spreading apparatus of claim 1, wherein the pressure roller is movable towards the spread sheet material under an adjustable pressure force.

4. The sheet material spreading apparatus of claim 1, further comprising a pivotal arm pivotally mounting the pressure roller on the carriage for moving the pressure roller between the operative and rest positions.

5. The sheet material spreading apparatus of claim 1, further comprising a retaining device for holding an end of the continuous length of sheet material supplied from a respective one of the rolls at the delivery station against the work table surface.

6. The sheet material spreading apparatus of claim 1, further comprising a respective transverse guide track mounted on the storage drum and trailing a respective one of the clamps, each guide track guidingly supporting the cutting device in the delivery position.

7. An apparatus for spreading a continuous length of sheet material on a surface of a work table, which comprises a sheet material spreading carriage movable over the work table surface between a sheet material delivery station and a sheet material cutting station spaced therefrom, the carriage comprising (*a*) a supply of the sheet material, the sheet material supply including
  (1) a rotatable storage drum,
  (2) at least two drivable sheet material supply rolls rotatably journaled in the storage drum for supplying the sheet material,
  (3) a sheet material clamp fixedly associated with each supply roll,
  (4) the storage drum being rotatable into a sheet material delivery position wherein a respective one of the supply rolls and associated clamps are positioned adjacent the work table surface, the clamps being arranged to orient the sheet material supplied from the associated rolls at the delivery station to enclose an acute angle with the work table surface, and
  (5) a driven, rotatable reeling drum associated with at least one of the supply rolls for reeling a cover film of the sheet material supplied from the associated roll, (b) a cutting device arranged on the carriage behind the delivery position in the direction of supply of the sheet material for cutting the continuous length of sheet material spread on the working table surface into predetermined lengths, and (c) a pressure roller mounted on the carriage and movable towards and away from the spread sheet material between an operative and rest position.

8. An apparatus for spreading a continuous length of sheet material on a surface of a work table, which comprises a sheet material spreading carriage movable over the work table surface between a sheet material delivery station and a sheet material cutting station spaced therefrom, the carriage comprising (a) a supply of the sheet material, the sheet material supply including
  (1) a rotatable storage drum,
  (2) at least two drivable sheet material supply rolls rotatably journaled in the storage drum for supplying the sheet material and
  (3) a sheet material clamp fixedly associated with each supply roll,
  (4) the storage drum being rotatable into a sheet material delivery position wherein a respective one of the supply rolls and associated clamps are positioned adjacent the work table surface, the clamps being arranged to orient the sheet material supplied from the associated rolls at the delivery station to enclose an acute angle with the work table surface, (b) a cutting device arranged on the carriage behind the delivery position in the direction of supply of the sheet material for cutting the continuous length of sheet material spread on the working table surface into predetermined lengths, (c) a pressure roller mounted on the carriage and movable towards and away from the spread sheet material between an operative and rest position, and (d) a retaining device for holding an end of the continuous length of sheet material supplied from a respective one of the rolls at the delivery station against the work table surface, the retaining device comprising
  (1) an auxiliary carriage movable over the work table surface and
  (2) a retaining ledge pivotally linked to the auxiliary carriage, the retaining ledge being displaceable into the delivery station between the cutting device and the delivery position by relative movement of the carriages.

9. The sheet material spreading apparatus of claim 8, wherein the pressure roller is arranged to be pressed against the retaining ledge upon displacement into the delivery station.

10. The sheet material spreading apparatus of claim 8, wherein the auxiliary carriage supports additional operating tools.

* * * * *